US008616463B2

(12) United States Patent
Mimlitch, III et al.

(10) Patent No.: US 8,616,463 B2
(45) Date of Patent: Dec. 31, 2013

(54) MODULAR TRACK FOR AUTONOMOUS VEHICLES

(75) Inventors: Robert H. Mimlitch, III, Rowlett, TX (US); David Anthony Norman, Greenville, TX (US); Joel Reagan Carter, Argyle, TX (US); Douglas Michael Galletti, Allen, TX (US); Gregory E. Needel, Rockwall, TX (US); Jeffrey R. Waegelin, Rockwall, TX (US); Gregory Lavendar, Rockwall, TX (US)

(73) Assignee: Innovation First, Inc., Greenville, TX (US)

( * ) Notice: Subject to any disclaimer, the term of this patent is extended or adjusted under 35 U.S.C. 154(b) by 180 days.

(21) Appl. No.: 13/253,715

(22) Filed: Oct. 5, 2011

(65) Prior Publication Data

US 2012/0080533 A1 Apr. 5, 2012

Related U.S. Application Data

(60) Provisional application No. 61/390,005, filed on Oct. 5, 2010.

(51) Int. Cl.
*E01B 23/00* (2006.01)

(52) U.S. Cl.
USPC ..... 238/10 R

(58) Field of Classification Search
USPC .... 238/10 R, 10 A, 10 B, 10 C, 10 F; 104/53, 104/55, 60, 68, 69
See application file for complete search history.

(56) References Cited

U.S. PATENT DOCUMENTS

| | | | | |
|---|---|---|---|---|
| 3,858,875 | A | 1/1975 | Nemeth et al. | |
| 4,169,334 | A | 10/1979 | Breslow et al. | |
| 4,537,577 | A | 8/1985 | Sansome et al. | |
| 4,575,354 | A | 3/1986 | Wakayama et al. | |
| 5,232,154 | A * | 8/1993 | Jenkins et al. | 238/10 F |
| 5,660,595 | A | 8/1997 | Ferro et al. | |
| 6,328,500 | B1 * | 12/2001 | Rubio | 404/32 |
| 2007/0037480 | A1 | 2/2007 | Jarck | |
| 2007/0259600 | A1 | 11/2007 | Bedford et al. | |
| 2010/0081356 | A1 | 4/2010 | Lutchen et al. | |

OTHER PUBLICATIONS

Notification of Transmittal of the International Search Report and the Written Opinion of the International Searching Authority, or Declaration (1 page); International Search Report (2 pages); and Written Opinion of the International Searching Authority (8 pages), mailed Feb. 27, 2012, for related international application PCT/US2011/054951.

* cited by examiner

*Primary Examiner* — R. J. McCarry, Jr.
(74) *Attorney, Agent, or Firm* — Adam K. Sacharoff

(57) ABSTRACT

An apparatus includes modular track sections adapted to be assembled into a track for autonomous vehicles. The track is configured such that the vehicles tend to stay on the track and that allows the autonomous vehicles to enter and exit the track from at least one side of the track.

4 Claims, 13 Drawing Sheets

MODULAR TRACK FOR AUTONOMOUS VEHICLES

CROSS-REFERENCE TO RELATED APPLICATIONS

This application claims the benefit under 35 U.S.C. §119 (e) of U.S. Patent Application No. 61/390,005, entitled "Modular Track for Autonomous Vehicles," filed Oct. 5, 2010, which is incorporated herein by reference in its entirety.

BACKGROUND

This specification relates to modular tracks that can be used for autonomous vehicles, such as battery-powered toys.

Tracks for toy vehicles typically include multiple track components that include a rolling surface and sidewalls. Toy cars that are self-propelled or that are accelerated by an external force can traverse such tracks and be maintained on the track by the sidewalls and/or acceleration forces (e.g., generated by tight loops when the vehicle has sufficient speed). Electrically-powered toy cars that are powered through contact with positive and negative rails can also be maintained on a track through the use of a slot in the track and a corresponding pin on the car.

SUMMARY

This specification describes technologies relating to tracks for autonomous devices.

In general, one innovative aspect of the subject matter described in this specification can be embodied in apparatus that include a plurality of modular track sections adapted to be assembled into a track for autonomous vehicles, wherein the track is configured such that the vehicles tend to stay on the track and that allows the autonomous vehicles to enter and exit the track from at least one side of the track. Other embodiments of this aspect include corresponding systems and methods of using the apparatus.

These and other embodiments can each optionally include one or more of the following features. The track forms an arena area bounded by the track that allows the vehicles to alternately move around in the arena and enter the track. A surface of the track adjacent to the arena area includes a surface having a different material than a material used for other surfaces of the track section. The track sections include a lateral slope and include ridges adapted to tend to maintain the vehicle on the track by counteracting gravitational forces due to the lateral slope. The track sections include a high outer bank. The track sections include a first ridge along a top surface of the track section adapted to engage an inner surface of one or more wheels of a vehicle to tend to keep the vehicle on the track. The track sections include a second ridge along a top surface of the track adapted to engage an outer surface of one or more wheels of the vehicle to tend to keep the vehicle from moving up a lateral slope of the track section. The track sections include a cross section adapted to prevent selected wheels of the vehicle at different lateral spacings from contacting an upper surface of the track when the vehicle is in a particular lateral position on the track section. The track sections include a cross section adapted to contact an underbelly of the vehicle. The cross section adapted to contact an underbelly of the vehicle tends to prevent the vehicle from exiting the track. The track sections include a cross section adapted to provide a predetermined statistical balance between a vehicle remaining on the track and leaving the track. The track sections are adapted for use with a vehicle having a plurality of wheels, with at least one pair of the plurality of wheels have a different lateral spacing than another pair of the plurality of wheels. The track sections are adapted for use with a vehicle having a plurality of wheels, with at least one pair of the plurality of wheels have a different diameter than another pair of the plurality of wheels. The track sections are adapted for use with a vehicle having a plurality of non-round wheels adapted to cause the vehicle to bounce as the wheels turn and propel the vehicle across a surface.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
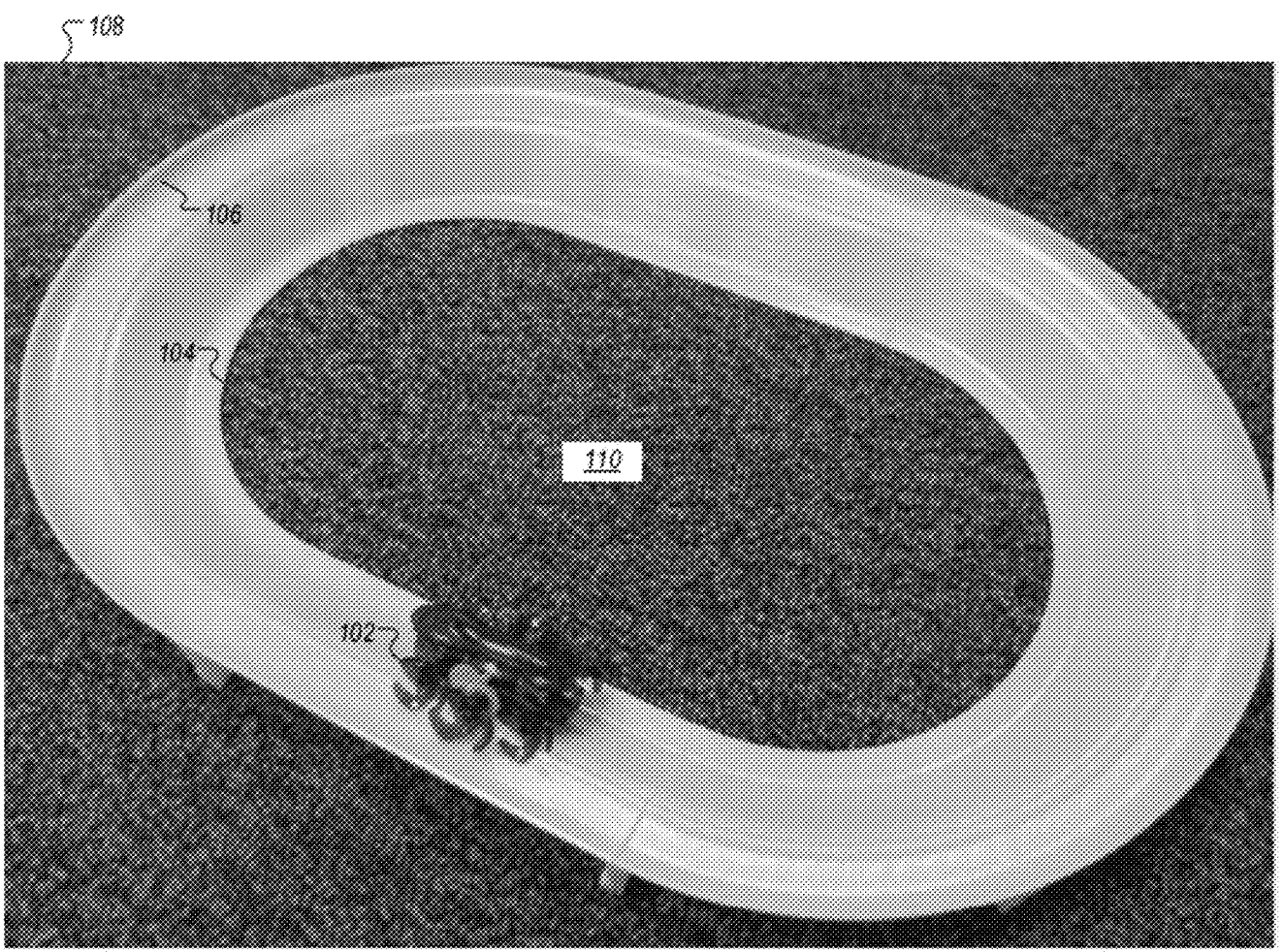
FIG. 1 illustrates an example modular track for autonomous vehicles.

FIG. 1 illustrates an example modular track 100 for autonomous vehicles (e.g., a vehicle 102). The track 100 is configured such that one or more vehicles 102 tend to stay on the track 100 in banked areas while allowing the vehicles to enter and exit the track 100 from at least one side. The track 100 includes an inner edge 104 and an outer edge 106. The inner edge 104 can be a portion of the track 100 that rests upon a surface 108. Example surfaces 108 include tile, hardwood floors, carpeted floors, rugs, table tops, and so on. The outer edge 106 is elevated relative to the inner edge 104 and the surface 108.

The inner edge 104 defines an arena area 110 on the surface 108. In some implementations, during operation of one or more vehicles 102, the vehicles 102 can move within an area 112 that includes the arena area 110 and the track surface between the edges 104 and 106. The vehicles 102 can enter and exit the track 100 from the arena area 110. Although the arena area 110 is depicted as an oval, other configurations are possible depending on the shape of the modular track sections and how the track sections are assembled. The track 100 can be designed to facilitate entry onto the track (at least if the vehicle 102 approaches the track within a particular range of angle) and to make the vehicles generally (but not necessarily exclusively) tend to stay on the track.

For example, two vehicles 102 may generally circle the track 100 and occasionally come into contact with each other. As a result of such contact (and/or as a result of random motion of the vehicles—e.g., resulting from bouncing of the vehicle on non-round "wheels"), one or more of the vehicles 102 may drop into the arena area 110 where they may further contact each other. Interactions in the arena area 110 among the one or more vehicles 102 (or simply the movement of a vehicle 102 toward the track) may cause one or more of the vehicles 102 to return to the track 100 and begin circling again. The slope and shape of the track 100 can prevent the vehicles 100 from moving beyond the outer edge 106.

The modular track 100 comprises several individual track sections that can be fastened together (e.g., using tongue-and-groove fittings) to form the track 100 in various configurations. Individual track sections can be straight sections of different lengths and curved sections of various arc lengths. The example track 100 has an oval shape, but other shapes and configurations of the track 100 can exist. For example, a vehicle 102 can operate on a non-oval track that has S-turns (e.g., a left turn and right turn in sequence), or a variety of turns.

Various materials can be used to manufacture sections of the track 100, including different types of plastics or other materials. For example, plastic track sections can be injection-molded or manufactured in other ways. Portions of the track surface can include other materials (e.g., rubber) or plastics that have different coefficients of friction. For example, an inner edge 104 that has a different coefficient of friction relative to the rest of the track 100 can help keep the vehicle 102 on the track 100 by causing the vehicle 102 wheels to grip and tend to turn the vehicle 102 toward the outer edge 106. In some implementations, the material that is selected for the inner edge 104 can help a vehicle 102 enter the track 100 from the arena area 110 regardless of the type of surface material (e.g., high friction or low friction) in the arena 110.

The purpose of the banked track surrounding an arena is to create multiple environments for the vehicles to interact, or battle. As described below, the cross section shape of the track can be designed to ensure that vehicles can proceed from the arena area to the track area. This arena-to-track movement can be made more or less difficult in order to create a balanced play that involves a desired time in the arena and time on the track (i.e., as desired by the designer of the track). The vehicles are preferably autonomous (not remote controlled) and are preferably designed to drive in a random and life-like manner. This autonomous life like movement, combined with the vehicles randomly moving from one area to the other, adds to the life-like appearance of the vehicles, and therefore, the realistic appearance of the vehicle battle. Tuning the characteristics of the track cross section can be done to create a desired statistical balance of the time the vehicle spends on the track and on the arena, as well as the statistical likelihood that the vehicle successfully transitions from one region to the other.

Figure 2A:
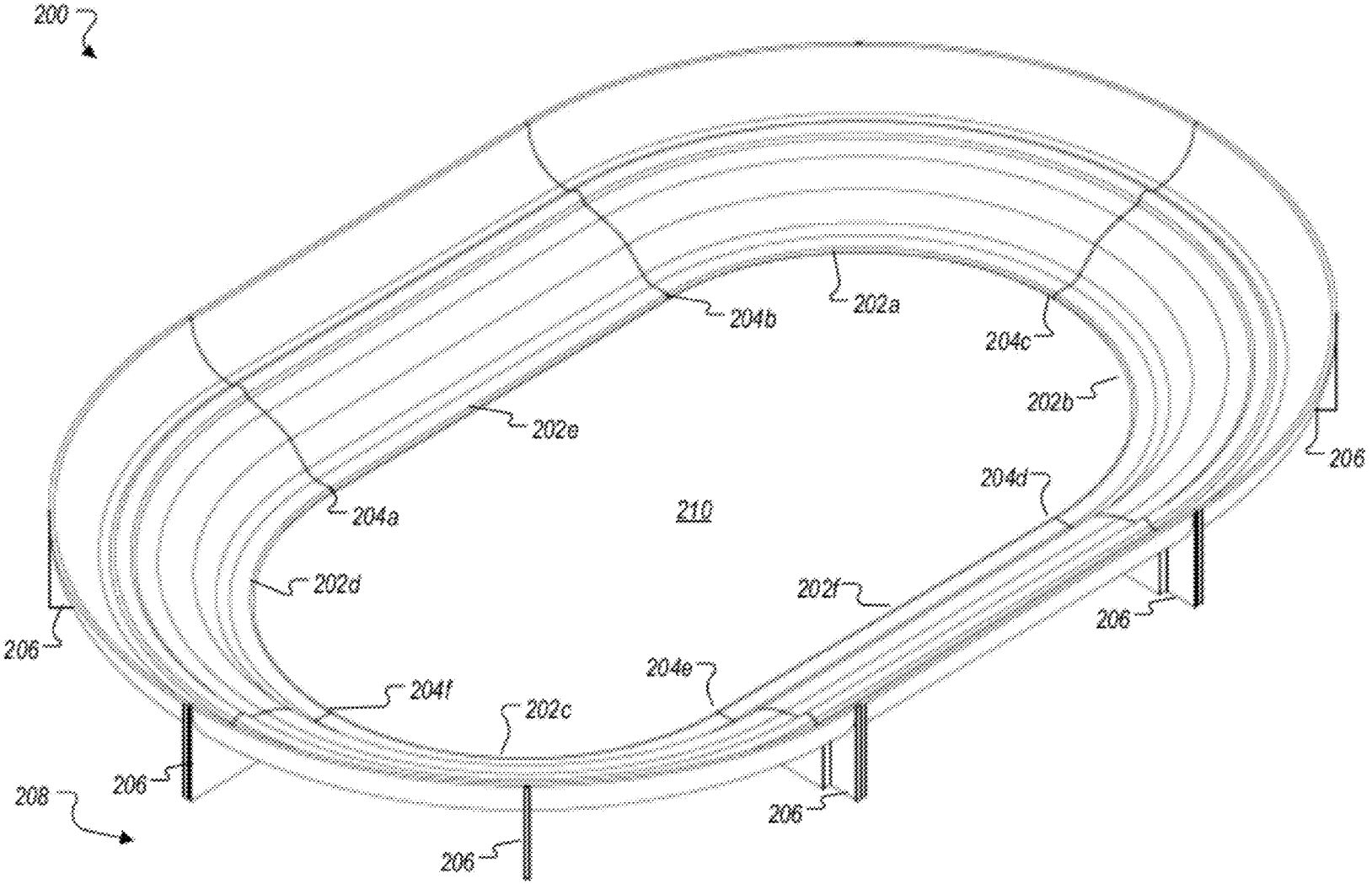
FIG. 2A is an isometric view of an example modular track.

FIG. 2A is an isometric view of an example modular track 200. The example modular track 200 consists of six track sections 202*a*-202*f*. The track sections 202*a*-202*d* are curved sections, meaning that they form the curved portions of the track's oval shape. The track sections 202*e*-202*f* are straight sections. The track sections 202*a*-202*f* shown in FIG. 2A are fastened together to form the oval shape of the track 200. The oval shape is just one example track shape that can be formed with the track sections 202*a*-202*f*. For example, by omitting the track sections 202*e*-202*f* and using only curved sections of track, a round track 200 can constructed. More sophisticated track shapes can be constructed using a larger number of track sections, or various other types of curved sections (e.g., curved in a different direction, having a different radius of curvature, or having a different banked slope) and/or different lengths of straight sections.

The connection between any two adjacent sections 202*a*-202*f* forms a seam (e.g., seams 204*a*-204*f*). For example, the track sections 202*d* and 202*e* form the seam 204*a*, the track sections 202*e* and 202*a* form the seam 204*b*, and the track sections 202*a* and 202*b* form the seam 204*c*, and so on.

Each of the track sections 202*a*-202*f* include two or more supports 206 that support the sloped shape of the track sections 202*a*-202*f*, and further allow the track sections 202*a*-202*f* to rest on a generally flat surface 208. As will be described below, some of the supports 206 are formed at seams (e.g., seams 204*a*-204*f*) between two adjacent track sections.

Figure 2B:
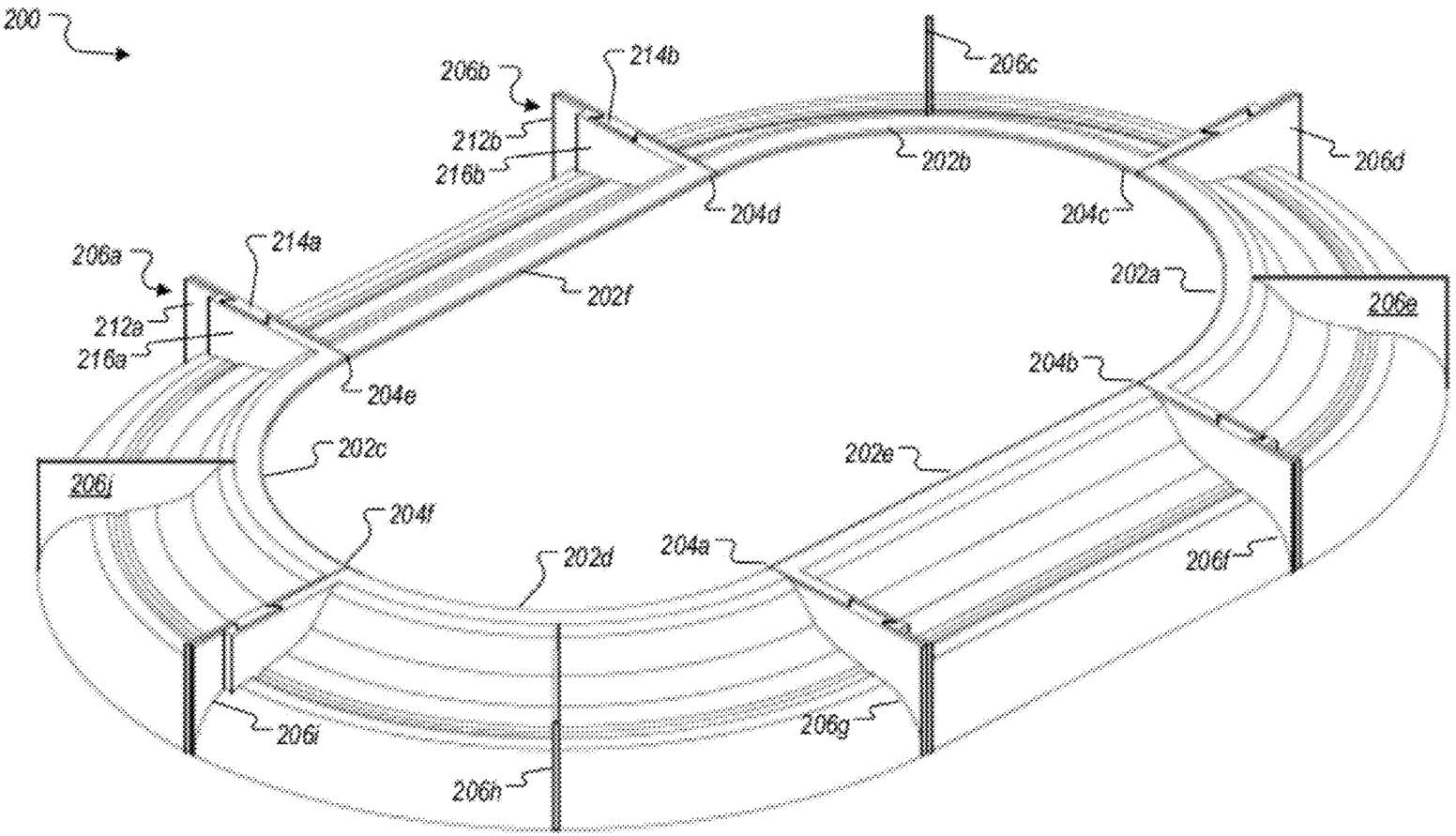
FIG. 2B is a reverse isometric view of the example modular track of FIG. 2A.

FIG. 2B is a reverse isometric view of an example modular track 200. In this view, the bottom of the assembled track 200 is shown, and as a result, a better view of the supports (e.g., supports 206*a*-206*j*) is also shown. Each of the curved sections 202*a*-202*d* includes an intermediate support that is generally positioned half-way along the length of the track section. For example, curved section 202*a* includes support 206*e*, curved section 202*b* includes support 206*c*, curved section 202*c* includes support 206*j*, and curved section 202*d* includes support 206*h*.

The supports at the ends of the straight sections 202*e* and 202*f* occur at seams between adjacent track sections. For example, the support 206*a* exists at (and consists of) the seam 204*e* between track sections 202*f* and 202*c*. The connecting end of the straight track section 202*f* includes a support element 212*a* having a tongue 214*a* that fits into a grooved element 216*a* that is part of the curved track section 202*c*. Similarly, the connecting end of the curved track section 202*b* includes a support element 212*b* having a tongue 214*b* that fits into a grooved element 216*b* that is part of the straight track section 202*f*.

In some implementations, other support mechanisms can be used that may or may not involve tongue-and-groove fasteners or supports that are formed by adjacent track sections. In some implementations, fewer or more supports can be used for different track sections. In some implementations, other types of fasteners can be used.

Figure 3A:
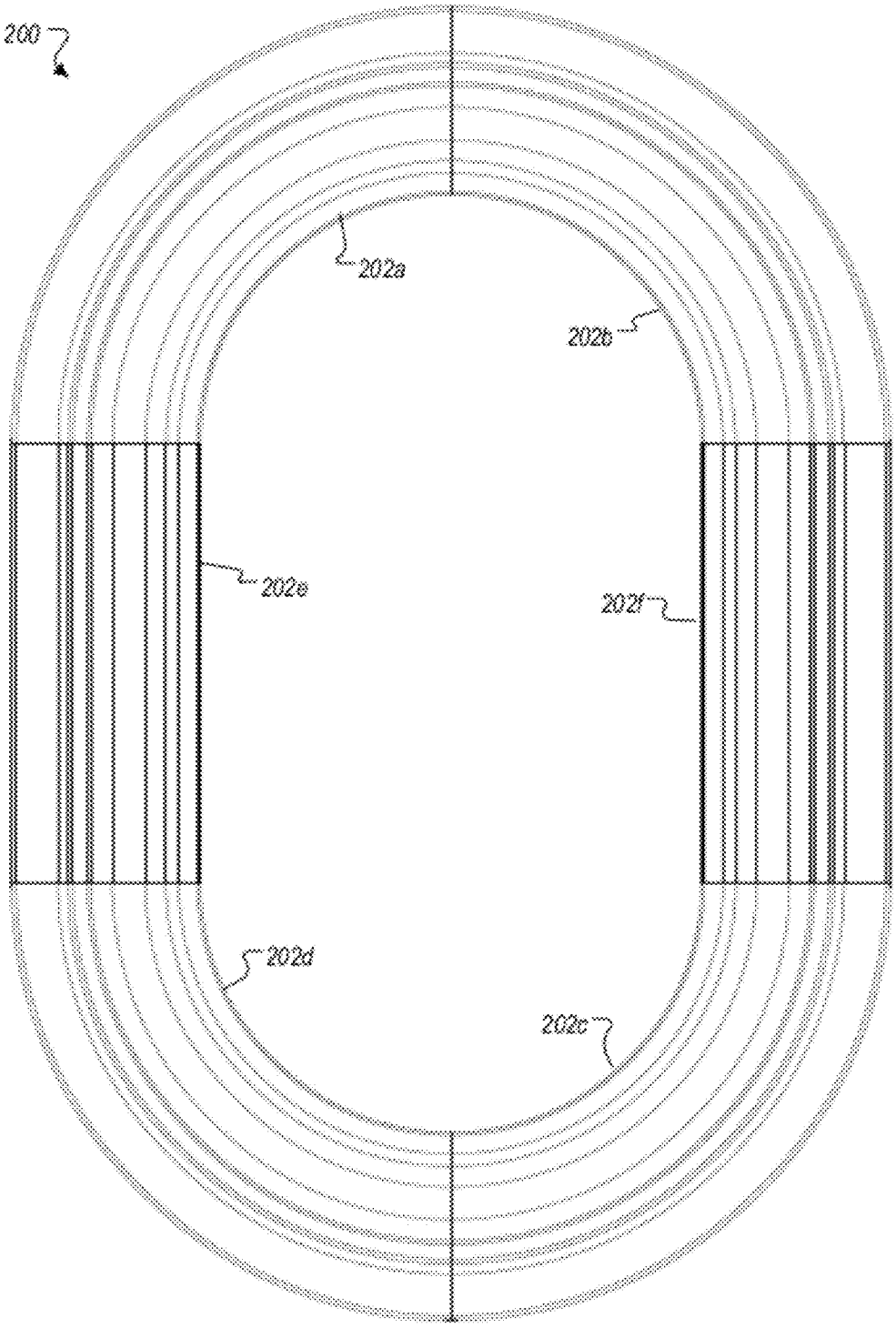
FIG. 3A is a top view of the example modular track of FIG. 2A.

FIG. 3A is a top view of the example modular track of FIG. 2A. This view shows the top surfaces of the track sections 202*a*-202*f*.

Figure 3B:
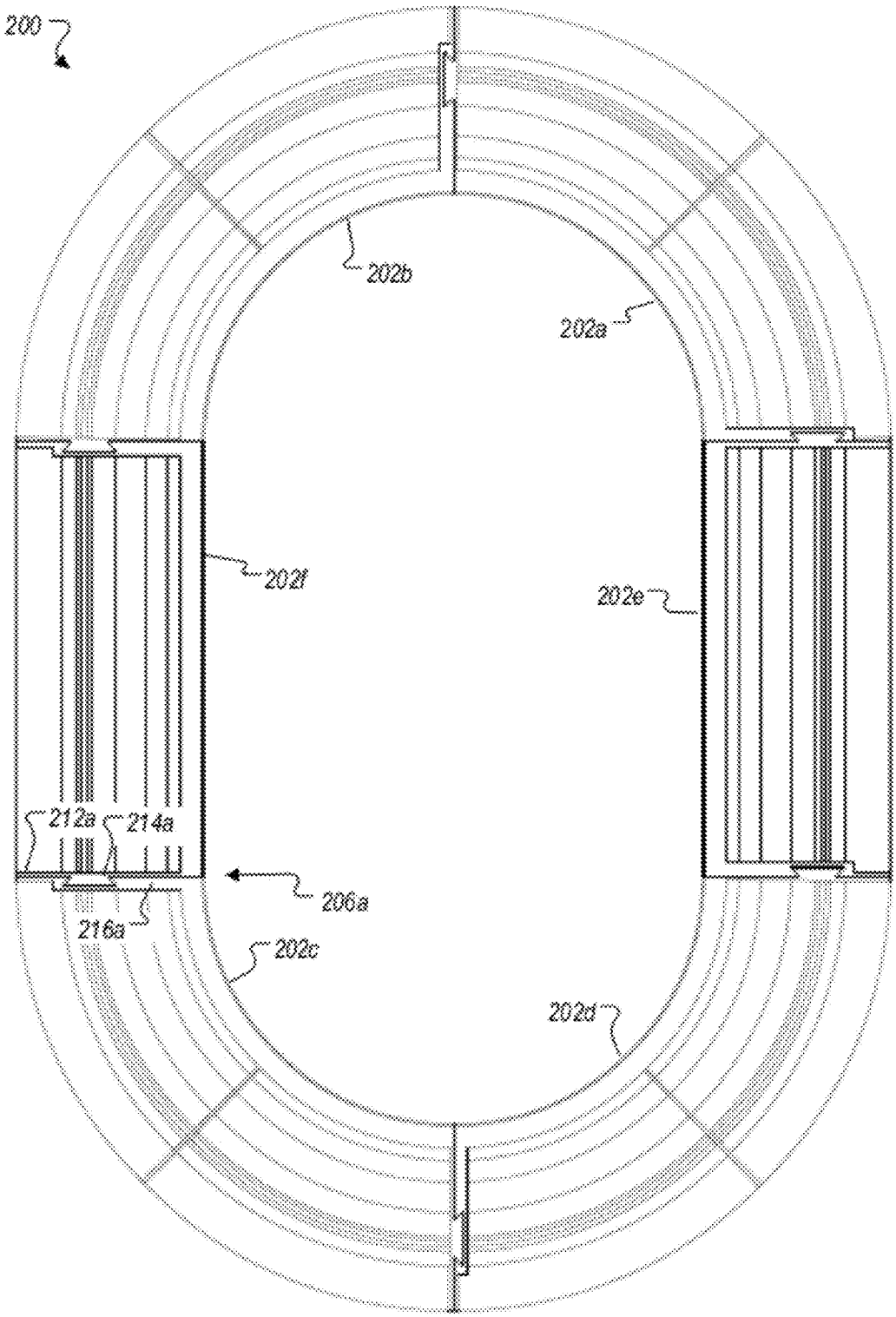
FIG. 3B is a bottom view of the example modular track of FIG. 2A.

FIG. 3B is a bottom view of the example modular track of FIG. 2A. This view shows the bottom sides of the track sections 202*a*-202*f*. In this view, the support 206*a* and the seam 204*e* between track sections 202*f* and 202*c* are more clearly shown. Specifically, this view more clearly shows the tongue 214*a* on the support element 212*a* that fits into the grooved element 216*a*.

Figure 4A:
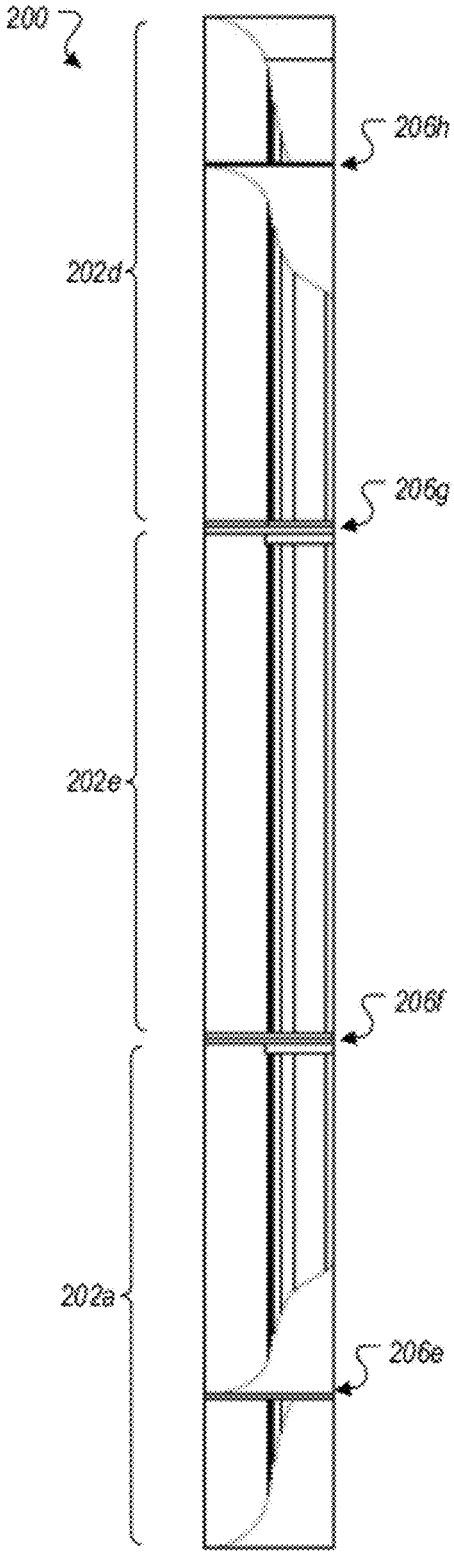
FIG. 4A is a left view of the example modular track of FIG. 2A.

FIG. 4A is a left view of the example modular track of FIG. 2A. In this view, the left side of the track 200 includes track sections 202*d*, 202*e* and 202*a* that are supported collectively, at least in part, by supports 206*h*, 206*g*, 206*f* and 206*e*.

Figure 4B:
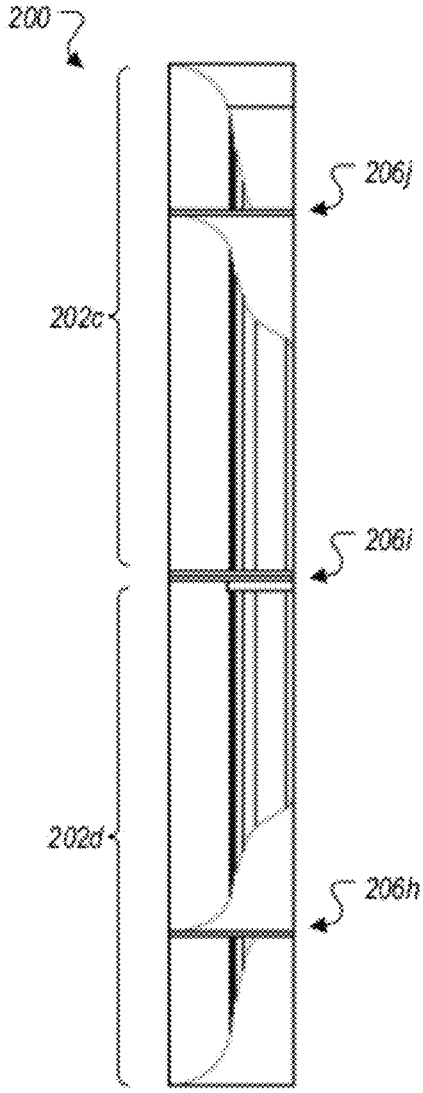
FIG. 4B is a front view of the example modular track of FIG. 2A.

FIG. 4B is a front view of the example modular track of FIG. 2A. In this view, the front side of the track 200 includes track sections 202*d* and 202*c* that are supported collectively, at least in part, by supports 206*j*, 206*i* and 206*h*. The front and left sides of the track 200 include a common track section, which is the track section 202*d*.

FIGS. 5A-5G are views of example cross sections of a modular track. The cross section 502*a* depicts the track sitting on a surface 504. A vehicle 505 having a body 506 is shown on the top surface of the cross section 502*a* of the track. The vehicle 505 includes wheels 508-514. In some implementations, the track section can include an alternate surface 516*a*, which can be made of a different material (e.g., rubber) than the material used for the track section. For example, the wheel 514 is shown resting on the alternate surface 516*a*. The alternate surface 516*a* has a width 516*b*. The surface length 517 represents the part of the surface (that is shown) that can serve as an arena for the track (e.g., arena 110 as described with reference to FIG. 1).

The track cross-section can be designed to create a track that is open to vehicles moving from the arena to the track. The design can account or allow for vehicles also occasionally leaving the track, as a result of the autonomous random movement of the vehicles. The cross section has several features that affect vehicle interaction with the track, including the overall angle of the track, the friction of the track or portions of the track, the ridges on the track, the general curve the vehicle encounters when on the track and in climbing the track, and the diameter of the wheels touching the track as the vehicle travels in the intended location. The intended locations are shown for various cross sections in FIGS. 5A, 5B, and 5D-5G. The track can typically be designed to allow the vehicle to transition to and from the intended location. The track design can help the vehicle stay in the intended position, since the relatively slow speed of the vehicle is insufficient to create the centrifugal forces needed to keep the vehicle on the slope.

Wheels 508-514 can tend to keep the vehicle 505 on the track (e.g., and not sliding down and off the track) because of the cross-sectional shape of the track. For example, a high-banked outer area 518 can prevent the vehicle 505 from leaving the track on the highest outer edge of the track (e.g., by forcing the vehicle 505 to turn and stay on the track rather than going over the outer edge). A ridge 520 along the top surface of the track can engage one or more wheels of the vehicle 505 (e.g., wheel 510, which is touching the ridge 520), providing a rut-like area for the wheel to operate, which can tend to keep the vehicle 505 on the track. The upper surface of the track includes a ridge 521*a*, which in this example is almost touching the bottom side of the vehicle's body 506.

Depending on the position of the vehicle 505 on the track, some of the wheels 508-514 may not touch the surface of the track. For example, wheels 510 and 514 touch the surface, but wheels 508 and 512 do not touch the surface, as indicated by gaps 522*a* and 522*b*. Different wheels 508-514 can be touching the track at any one time, depending on fluctuations of the vehicle's lateral position relative to the slope of the track. Furthermore, shape variations (e.g., ridges such as the ridge 520) can help to steer the vehicle 505 to a more stable position along the track. The features of the track (e.g., ridge 520 and the track shape that causes gaps 522*a* and 522*b*) can be designed to keep particular wheels (e.g., smaller, slightly farther internal wheel 510 on the side of the vehicle toward the upper edge of the track and larger, outside wheel 514 on the side of the vehicle toward the arena) in contact with the track and other specific wheels from contacting the track (e.g., larger, external wheel 508 on the side of the vehicle toward the upper edge of the track and smaller, inside wheel 512 on the side of the vehicle toward the arena) when the vehicle 505 is in a stable position on the track. The varying wheel sizes, locations, and degrees of contact can facilitate maintaining the vehicle in position on the track (e.g., by causing the lower contacting wheel 514 to tend to drive the vehicle to turn toward the track and preventing the upper non-contacting wheel 508 from tending to drive the vehicle to turn away from the track). In the position shown, the vehicle is riding in a stable, intended position with three wheels contacting the track, e.g., the lower center wheel 512 and the two upper front and rear wheels 510. (In the cross section 502*a* (and in other cross sections 502*b*-502*g*), assume that another wheel 510 is behind the visible wheel 510.) In this position, the forward velocity created by the lower larger diameter wheel 512 is higher than the forward velocity caused by the upper smaller diameter wheels 510, resulting in a general tendency to climb the track and stay in the intended position and not slide down the track.

Figure 5A:
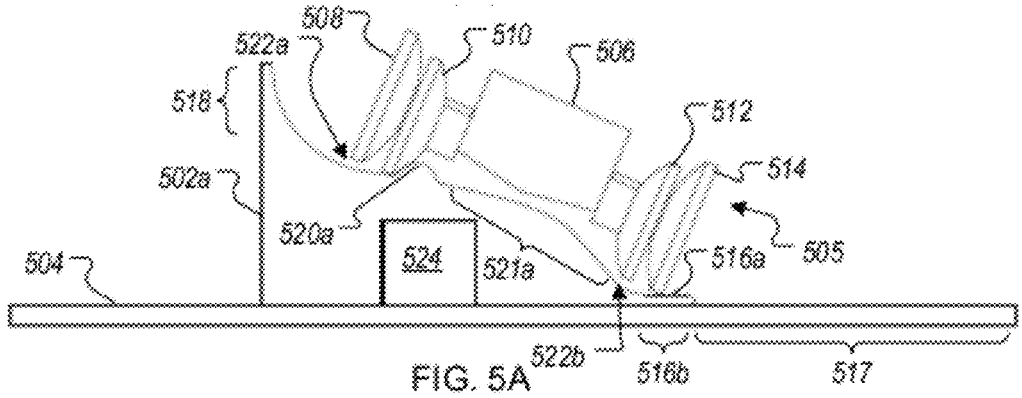
FIGS. 5A-5G are views of example cross sections of a modular track.
Figure 5B:
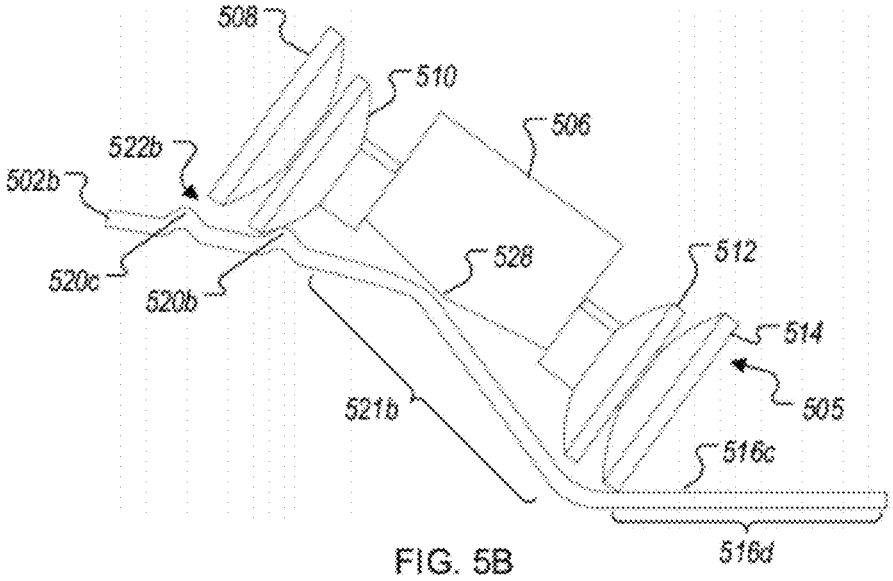

The cross section 502*b* of FIG. 5B differs from the cross section 502*a* of FIG. 5A in several ways. First, the cross section 502*b* includes two ridges, namely ridges 520*b* and 520*c*. Secondly, the upper surface of the track has a more pronounced, peak-shaped transition region 521*b* (as compared to the transition region 521*a*, for example), which at times can come into contact with the vehicle 505 at a belly area 528 on the vehicle's body 506. In some implementations, contact between the transition region 521*b* and belly area 528 can tend to keep the vehicle 505 on the track. A third difference between the cross section 502*b* and the cross section 502*a* is the size of an alternate surface 516*c* as compared to the alternate surface 516*a*. For example, the alternate surface 516*c* has a wider width 516*d* as compared to the width 516*a*.

Figure 5C:
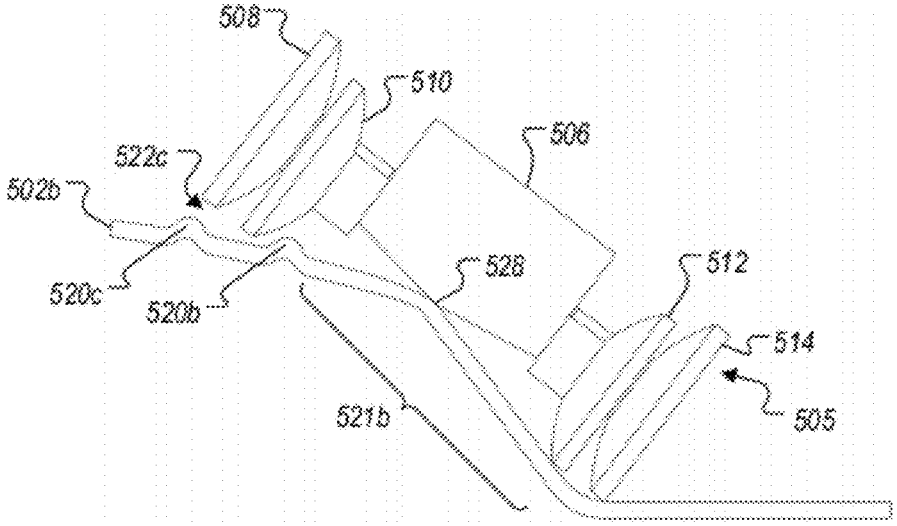

FIG. 5C shows the same cross section 502*b* that is shown in FIG. 5B, except in this case the vehicle 505 is higher on the track (or further to the left in this view). As a result, the transition region 521*b* and belly area 528 are touching. Furthermore, the wheels 508 and 510 are not touching the surface of the track, as indicated by a gap 522*c*, which can help prevent the wheels 508 and 510 from providing a driving force that might tend to cause the vehicle 505 to exit the track by turning toward the right. In some cases, when wheels 508 and 510 are not touching the track, the vehicle will slow and return to the preferred riding position shown in FIG. 5B. This slowing of the vehicle and returning to the preferred position is self-regulating. In some cases, frictional forces between the transition region 521*b* and belly area 528 can help to push the car back into a position on the track where at least the wheel 510 can again engage the surface of the track. FIG. 5C depicts a riding position that results in the vehicle being more likely to transition from the track and return to the arena. This reason for the increased likelihood of transition is that the vehicle is no longer riding on three points (e.g., one lower wheel and two upper wheels) and instead is riding on two points (e.g., the belly area 528 and lower wheel), resulting in the vehicle easily changing direction.

Figure 5D:
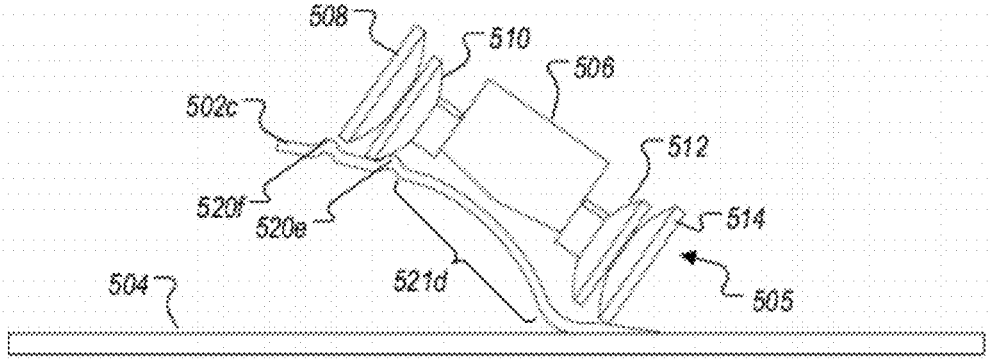

As shown in FIG. 5D, the cross section 502*c* is similar to the cross section 502*b* of FIGS. 5B-5C, except that the surface of the track in cross section 502*c* does not include a pointed area that is similar to the transition region 521*b* in the cross section 502*c*. The cross section 502*c* includes two ridges 520*e* and 520*f*. This lower ridge 520*e* is used to maintain the intended position, keeping the vehicle from sliding down the slope. The upper ridge 520*f* is used to keep the vehicle from riding too high on the track, which can be caused by the vehicle's random movement. The curved transition region

521*d* from the arena to ridge 520*e* can increase the ease of vehicle transition from arena to track, by providing a steep initial climb when the vehicle's speed is high, and a gradual climb as the vehicle nears the intended position while the vehicle's speed is reduced by the climb.

Figure 5E:
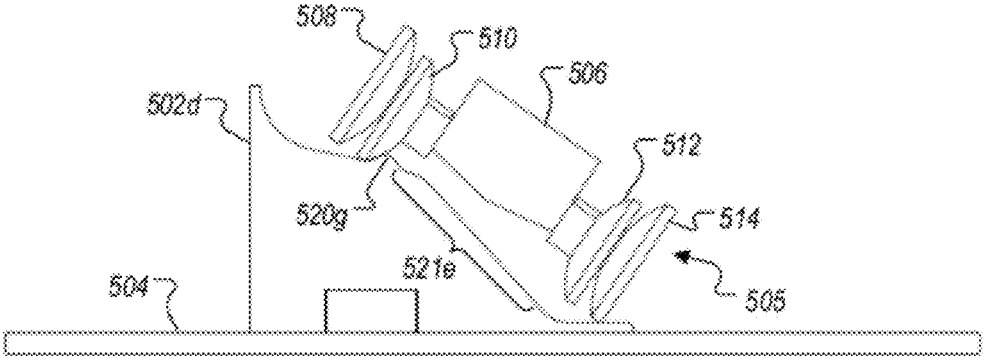

As shown in FIG. 5E, the cross section 502*d* is similar to the cross section 502*a* of FIG. 5A, except that the surface of the track in cross section 502*d* is steeper than the track in the cross section 502*a*. The cross section 502*d* includes a single ridge 520*g* that is shown catching the wheel 510, tilting the vehicle 505 at a greater angle that of the vehicle 505 in FIG. 5A. FIG. 5E also has a consistent transition region 521*e* from arena to ridge, which can reduce the vehicle's ease of reaching the intended position. At least in cases where it is desirable to regulate the statistical likelihood that the vehicle can successfully achieve transition from arena to track, this transition region 521 e can be altered in a variety of shapes (e.g., curved as in FIG. 5D, consistent slope as in FIG. 5E, or some variation in between) to achieve a desired result.

Figure 5F:
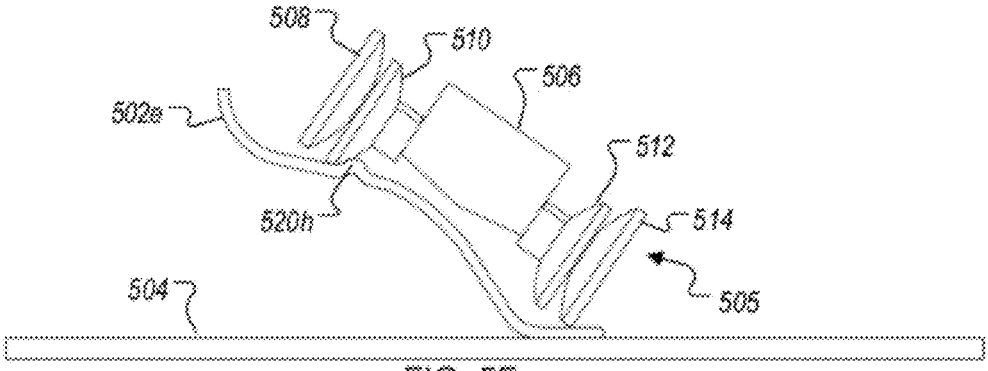

As shown in FIG. 5F, the cross section 502*e* is similar to the cross section 502*c* of FIG. 5D, except that the cross section 502*e* includes a single ridge 520*h*. The ridge 520*h* can be altered in height and shape to interact with the wheels in a way that helps achieve the desired statistical balance between vehicles remaining in the intended position and leaving the track to return to the arena.

Figure 5G:
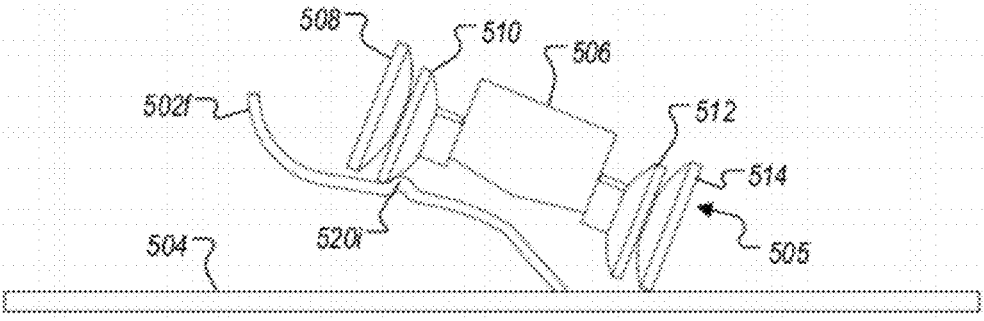

As shown in FIG. 5G, the cross section 502*f* is similar to the cross section 502*e* of FIG. 5F, except that the cross section 502*f* is less steep, resulting in a lower vertical position of a single ridge 520*i*. This cross section produces a lower vehicle angle, which may increase the vehicle's tendency to go from the arena area to the track. This cross section also allows the lower wheels to ride on the arena surface 504. Due to the unknown nature of this surface (e.g., it can be hard or soft, high friction or low friction, etc.), friction variances between the upper and lower wheels cannot be controlled, which may result in unpredictable behavior.

Figure 6:
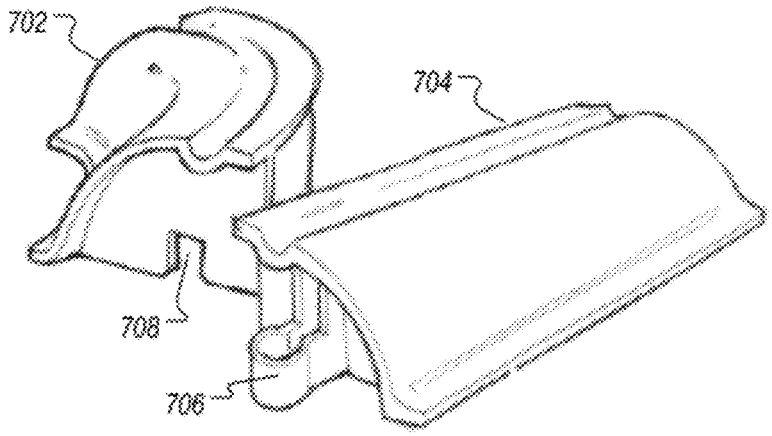
FIG. 6 shows example un-assembled track sections of a modular track.

FIG. 6 shows example un-assembled track sections 702 and 704 of a modular track. The track section 702 is a curved section of track. The track section 704 is a straight section of track. The two track sections 702 and 704 can connect together (or to other sections of track not shown) using a tab 706 on the track section 704 that fits into a hole 708 on the track section 702. The tab 706 and the hole 708 provide just one example way for connecting sections of track. In some implementations, other ways to connect sections of track can include tongue-and-groove connections, loop-and-hook connections, magnetic connections, or snap-together pieces, to name a few examples.

Figure 7:
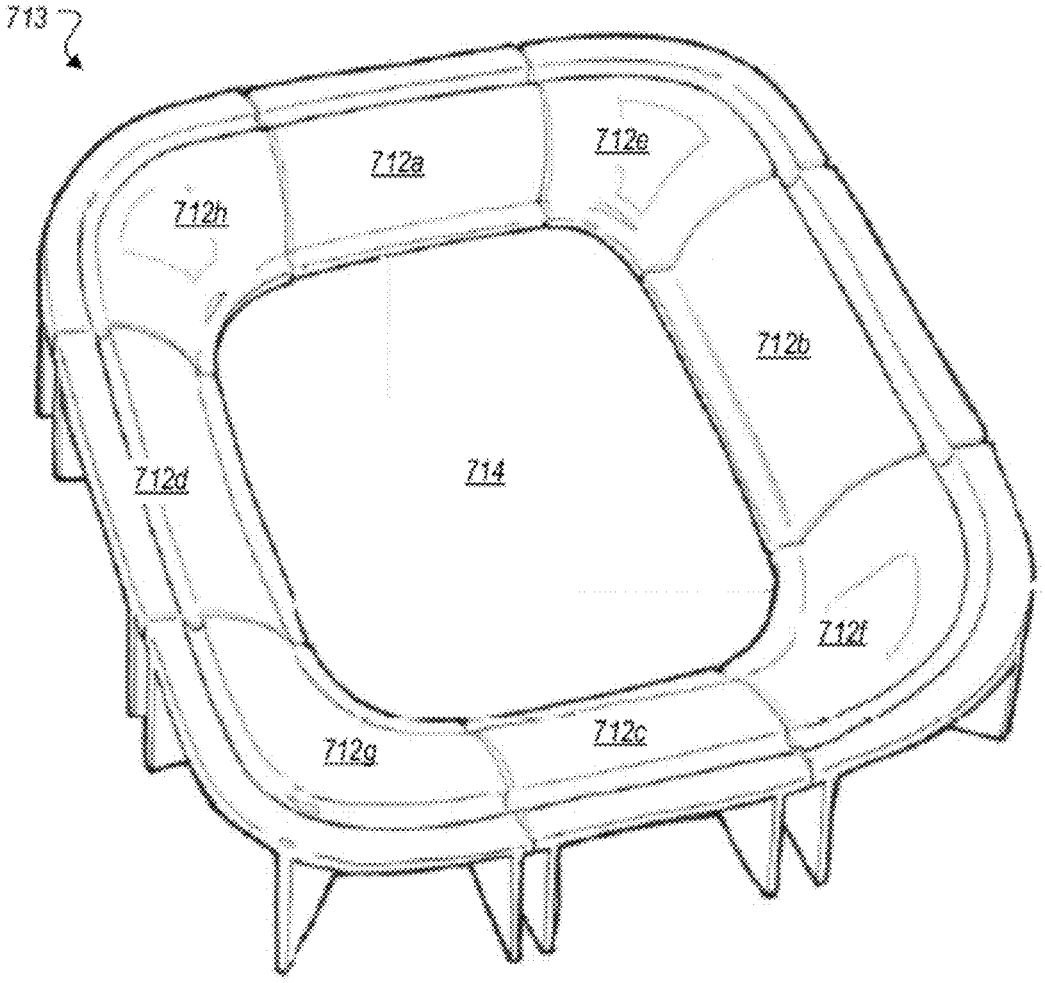
FIG. 7 shows example assembled track sections of a modular track.

FIG. 7 shows example assembled track sections 712*a*-712*h* of a modular track 713. In this example, the track sections 712*a*-712*h* form a generally oval or rounded rectangular track 713. The track sections 712*a*-712*d* are straight sections of track, and the track sections 712*e*-712*h* are curved sections of track. The assembled track 713 forms an arena area 714. In some implementations, one or more self-propelled or autonomous vehicles (e.g., toys) can use the track 713 and arena 714 during operation, such as in interaction between the vehicles for amusement purposes.

Figure 8:
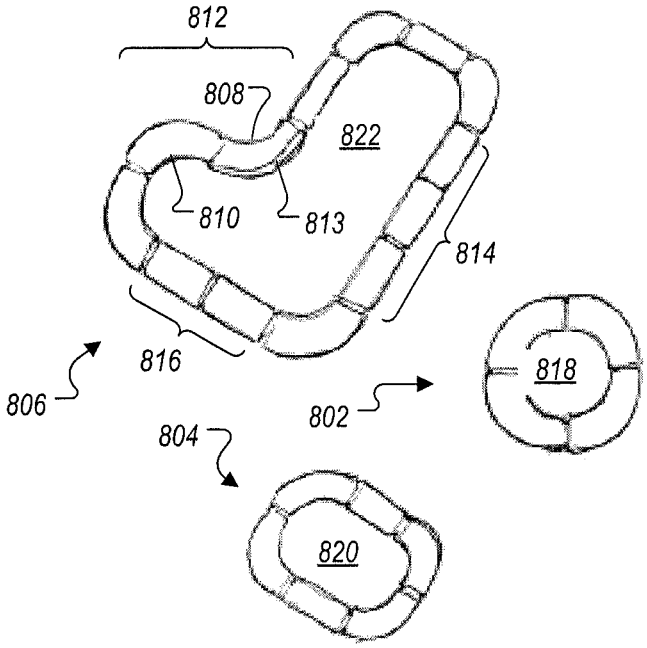
FIG. 8 shows different assembled configurations of a modular track.

FIG. 8 shows different assembled track configurations 802-806 of a modular track. The track configuration 802 is a round configuration that uses four curved track sections that are joined together. The track configuration 804 is an oval configuration that uses four curved track sections and two straight track sections that are joined together. The track configuration 806 is a more complex configuration that uses six curved track sections and seven straight track sections that are joined together.

The track configuration 806 includes two adjacent curved track sections 808 and 810. The track sections 808 and 810 provide consecutive left and right turns, or right and left turns, depending on the direction of travel of a vehicle on the track. As a result, the track sections 808 and 810 provide an S-turn for the vehicle. In some implementations, the track section 808 can have a different type of lower edge 813 than other "inside-turn" curved sections of track, such as track section 810. For example, the lower edge 813 can have a different shape or use different materials in order to help keep a vehicle on the sloped track even when the turn away from the slope tends to push the vehicle off the track.

The track configuration 806 includes three adjacent straight track sections 814 and two adjacent straight track sections 816. Having multiple consecutive straight track sections can, for example, allow a vehicle on the track to increase its speed after forces in curved sections of track tend to slow the vehicle.

The track configurations 802-806 form arena areas 818-822, respectively. The irregular shape of the arena area 822 can provide a more entertaining interaction between multiple vehicles that use the track.

Figure 9:
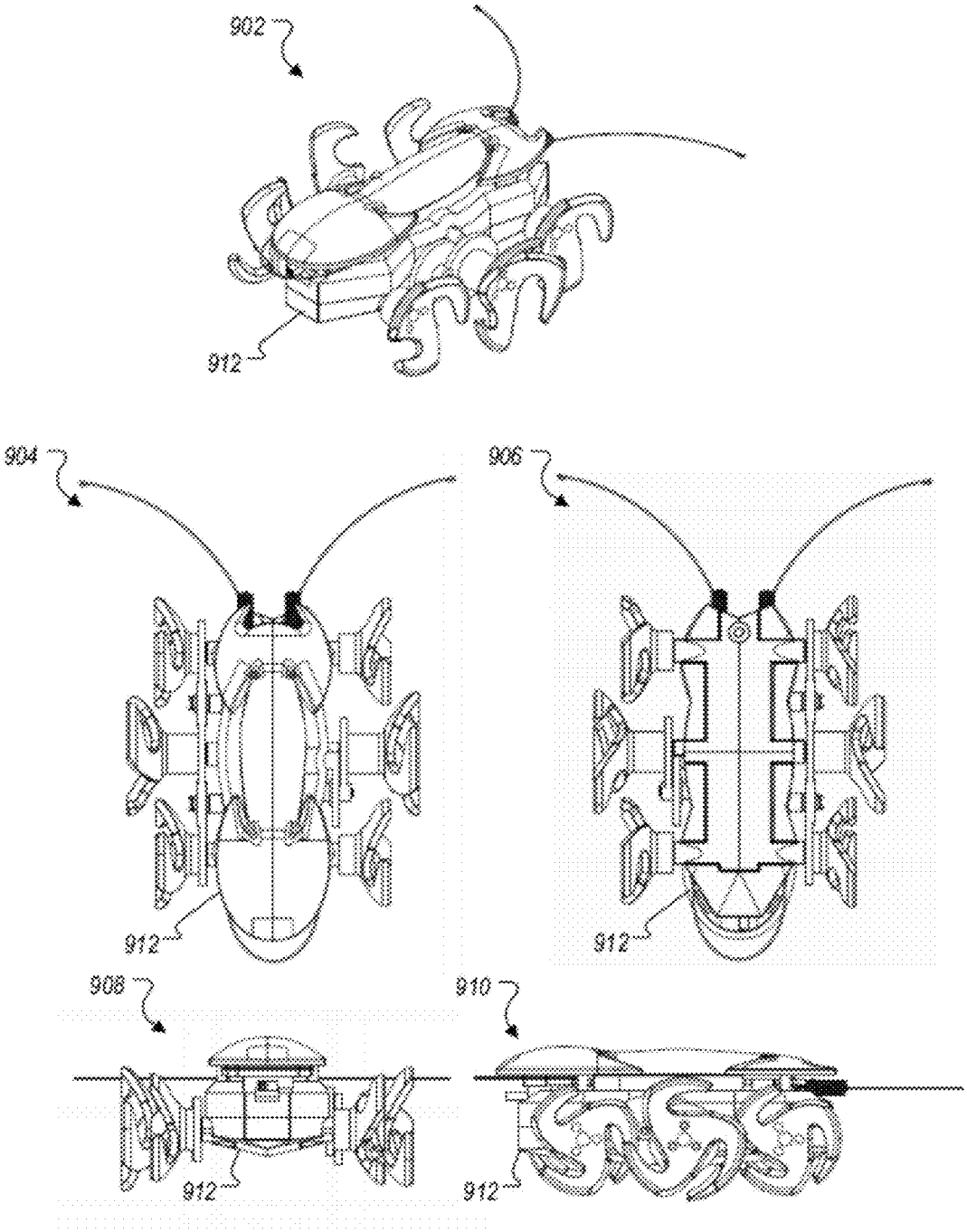
FIG. 9 shows different views of an example vehicle that can be used on the modular track.

FIG. 9 shows different views 902-910 of an example vehicle 912 that can be used on the modular tracks (e.g., tracks 100, 200, etc.) described in this disclosure. The vehicle 912 can also operate on tracks that have cross sections such as the cross sections 502*a*-502*g* that are described with reference to FIGS. 5A-5G. The view 902 is a perspective view of the vehicle 912 that, in this example, is shaped like a bug. The view 904 is a top view of the vehicle 912. The view 906 is a bottom view of the vehicle 912. The view 908 is a back view of the vehicle 912. The view 910 is a side view of the vehicle 912. Although the vehicle 912 is shaped like a bug, other shapes of the vehicle 912 and vehicles in general can be used on the modular tracks (e.g., tracks 100, 200, etc.) if, for example, the vehicles' wheels or other self-propulsion mechanisms are adaptable to the shape and slope of the track sections.

The vehicle is designed to create life-like movement that can be produced by creating chaotic driving conditions. The factors that create this include: low traction wheels that may slip occasionally, resulting in erratic movement direction; non-round wheels that cause the vehicle to continually bounce, resulting in more erratic traction and resulting direction; and larger center wheels that cause the vehicle to bounce front to rear resulting in more erratic traction and resulting direction.

Figures 10A, 10B, 10C:
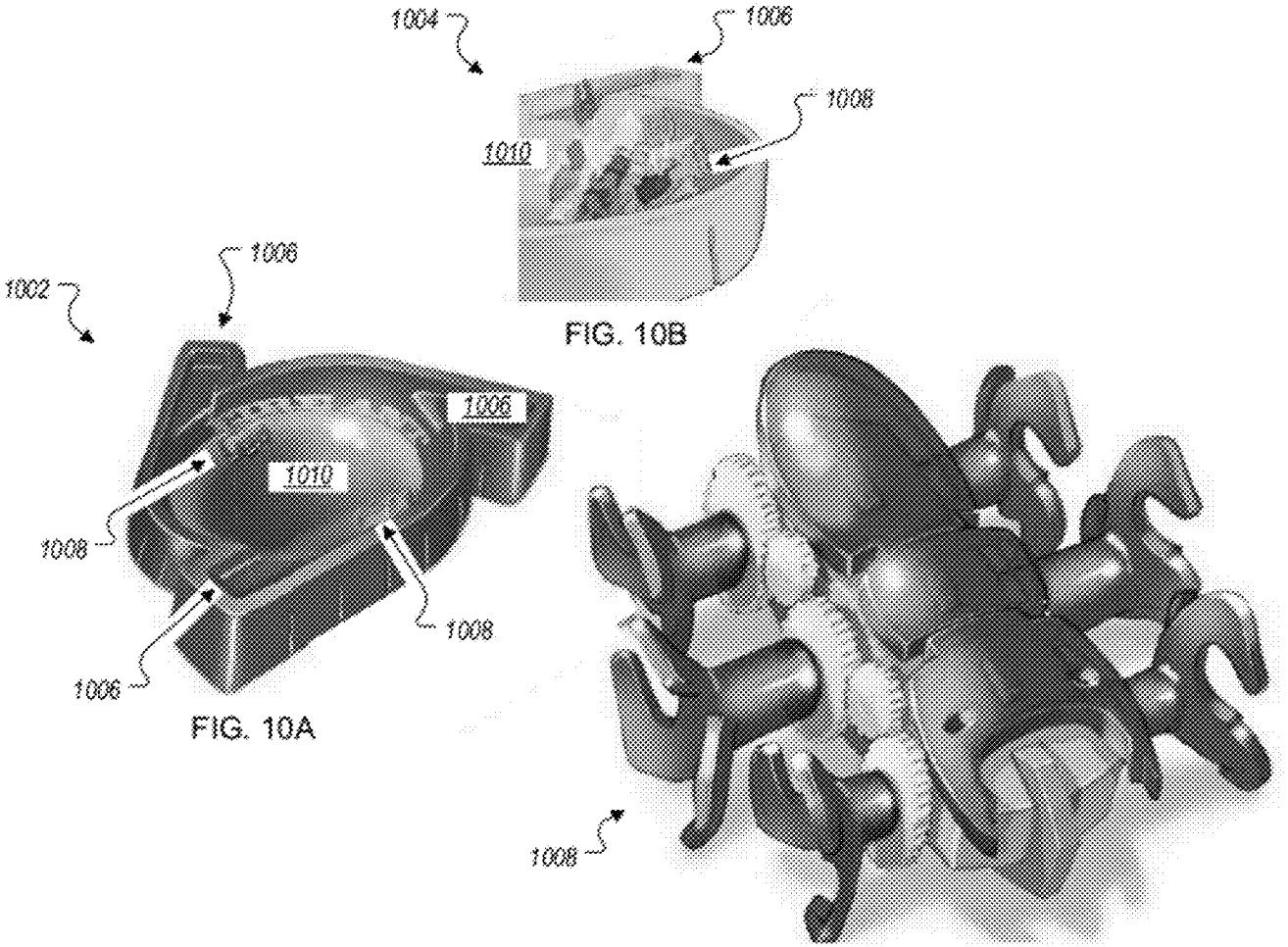
FIGS. 10A and 10B show example track and arena configurations.
FIG. 10C is a detailed view of an example break-away vehicle.

FIGS. 10A and 10B show example track and arena configurations 1002 and 1004. In contrast to the modular tracks described above, the track and arena configuration 1002 can be a single piece of plastic (e.g., injection-molded) or other material. In some implementations, the track and arena configuration 1002 can comprise multiple track pieces or sections that are fastened together in various ways.

Entry areas 1006 each provide an entry area for launching vehicles 1008 into the track, such as into a circular arena area 1010. In this example, the walls of the arena area 1010 may be sufficiently banked so that vehicles already in the arena area 1010 tend to remain there (e.g., tending not to return to any of the entry areas 1006).

The example track and arena configuration 1002 is just an example. Other configurations can include fewer or more entry areas 1006, or the arena area 1010 that is formed in the center may have different shapes, and so on.

The track and arena configuration 1004 shows a portion of the arena area 1010 in which vehicles 1008 are interacting. In this example, the vehicles 1008 have just crashed into each other, and break-away pieces of at least one of the vehicles are being scattered about.

FIG. 10C is a detailed view of an example break-away vehicle 1008 that can be used on tracks described within this disclosure (e.g., tracks 100, 200, or the example track and arena configurations 1002 and 1004.

Figure 11:
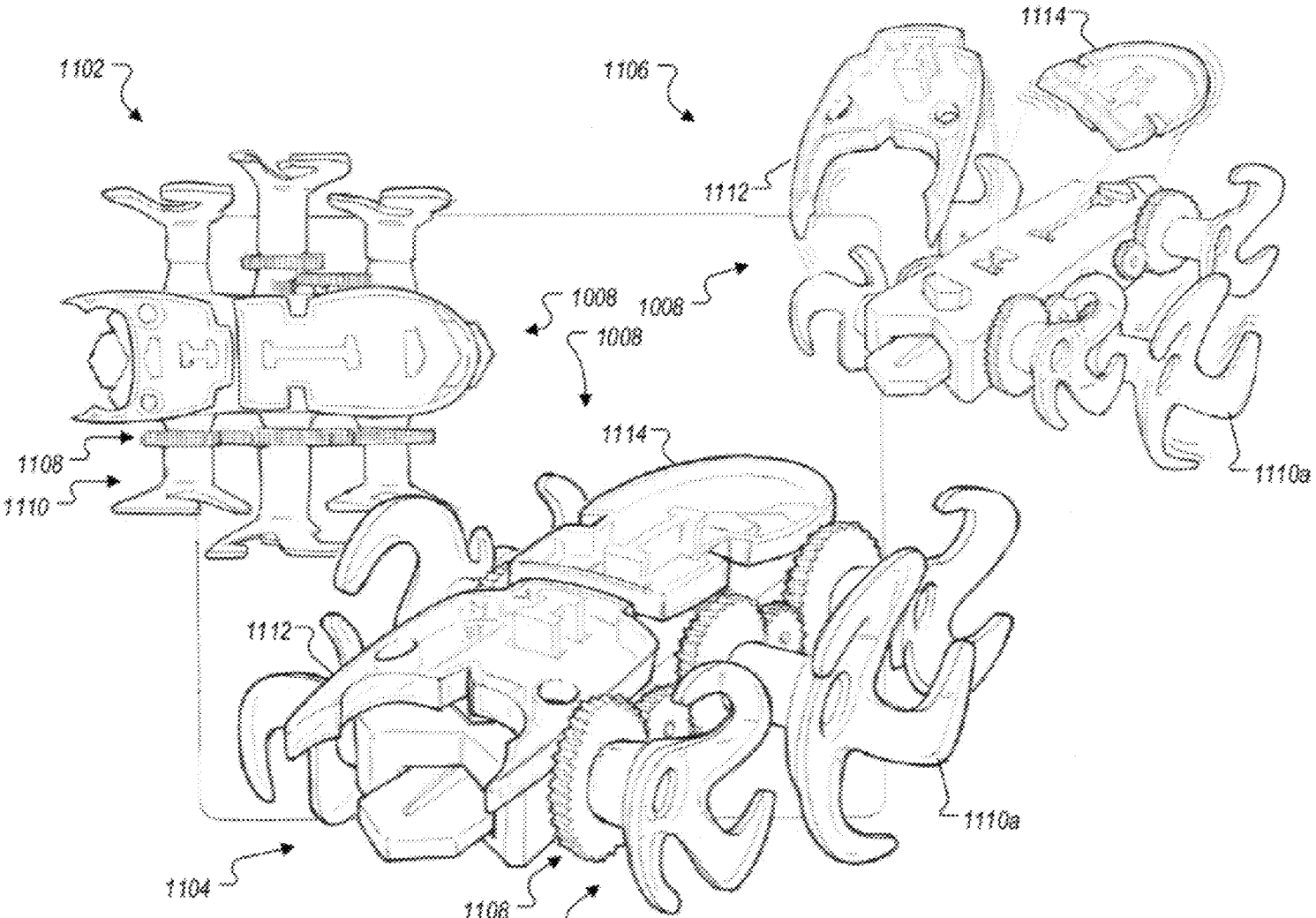
FIG. 11 shows different views of an example break-away vehicle.

FIG. 11 shows different views 1102-1106 of the example break-away vehicle 1008 of FIG. 10C. The view 1102 is a top view of the vehicle 1008, showing interconnected gears 1108 that rotate wheels 1110 to provide propulsion for the vehicle 1008. For example, the gears 1108 can be connected to a battery-powered motor and/or one or more other mechanisms that are embedded within the body of the vehicle 1008.

The view 1104 is a perspective view of the vehicle 1008. In this view, a pincher head 1112, a torso 1114, and an outer wheel 1110*a* are attached to the vehicle 1008. However, in the view 1106, the pincher head 1112, the torso 1114, and the outer wheel 1110*a* are shown exploding away from the vehicle 1008, e.g., as a result of the vehicle 1008 crashing into another vehicle 1008 or an obstacle of some kind In particular, the vehicle 1008 can include a trigger that causes pieces, including the wheels, to detach from the vehicle 1008, which may immediately or eventually (e.g., after several contacts with the trigger cause more pieces to detach) render the vehicle inoperable (e.g., until it is reassembled). The wheels lack a completely round shape and the middle wheel on each side is larger than an farther out than the front and back wheels on each side, all of which contributes to some instability and a tendency to increase random motion as the wheels spin rapidly and the vehicle 1008 bounces along a surface. The wheels can also be constructed of a low friction material that encourages slippage.

Thus, particular embodiments of the subject matter have been described. Other embodiments are within the scope of the following claims.

What is claimed is:

1. A toy track comprising:

a plurality of modular track sections adapted to be assembled into a closed track for autonomous vehicles and configured to be assembled on a surface, the closed track having an inside edge to define on the surface an area between the track sections of the dosed track, and wherein one or more of the track sections includes an cross-sectional profile defined to include:

an outside shoulder region being curved upwardly to an outer terminal edge for maintaining said autonomous vehicles on the track sections, wherein the outer terminal edge is positioned above the inside edge;

a first ridge positioned between the outside shoulder region and inside edge, the first ridge configured to substantially maintain contact between an inside portion of a wheel on the autonomous vehicle;

a transition region having a first terminus proximal to the first ridge and a second terminus proximal to the inside edge, and wherein the first terminus is positioned above the second terminus; and wherein the inside edge is positioned adjacent the surface, to define an entrance and exit of the one or more track section to the area on the surface between the track section allowing the autonomous vehicles to enter and exit the one or more track sections and the arena.

2. The toy track of claim 1, wherein the transition region is a convex surface or is a flat planar surface.

3. The toy track of claim 1, wherein the cross-sectional profile of the one or more track section further includes a second ridge positioned between the first ridge and the outside shoulder region, the second ridge configured to contact an outside portion of a wheel on the autonomous vehicle.

4. The toy track of claim 3, wherein the cross-sectional profile of the one or more track section further includes a concave portion between the first and second ridge.

* * * * *